US007945999B2

(12) United States Patent
Schmauser

(10) Patent No.: US 7,945,999 B2
(45) Date of Patent: May 24, 2011

(54) NEEDLE BAR FOR A WARP DRAWFRAME

(75) Inventor: Till Schmauser, Schwabach (DE)

(73) Assignee: Drei-S Werk Praezisionswerkzeuge GmbH & Co. Fertigungs-KG, Schwabach (DE)

( * ) Notice: Subject to any disclaimer, the term of this patent is extended or adjusted under 35 U.S.C. 154(b) by 0 days.

(21) Appl. No.: 12/413,930

(22) Filed: Mar. 30, 2009

(65) Prior Publication Data

US 2009/0241294 A1 Oct. 1, 2009

Related U.S. Application Data

(63) Continuation of application No. PCT/EP2007/008345, filed on Sep. 26, 2007.

(30) Foreign Application Priority Data

Sep. 28, 2006 (DE) ..... 20 2006 014 832 U

(51) Int. Cl.
*D01G 19/06* (2006.01)

(52) U.S. Cl. ..... 19/129 R

(58) Field of Classification Search ..... 19/115 R, 19/129 R, 129 A
See application file for complete search history.

(56) References Cited

U.S. PATENT DOCUMENTS

| | | | | |
|---|---|---|---|---|
| 7,159,280 | B2 * | 1/2007 | Voshell et al. | 19/129 R |
| 2005/0278899 | A1 | 12/2005 | Voshell, Sr. et al. | |
| 2008/0022493 | A1 * | 1/2008 | Schmauser | 19/115 R |

FOREIGN PATENT DOCUMENTS

| | | |
|---|---|---|
| GB | 1176671 A | 1/1970 |

OTHER PUBLICATIONS

International Search Report dated Jan. 23, 2008.

* cited by examiner

*Primary Examiner* — Shaun R Hurley
(74) *Attorney, Agent, or Firm* — Laurence A. Greenberg; Werner H. Stemer; Ralph E. Locher

(57) ABSTRACT

A needle bar has a carrier bar and a casing surrounding the latter and holding a number of needles lined up with one. The carrier bar has a diameter of, in particular, 7.2 mm and the casing has a thin-walled region with a wall thickness of, in particular, 1.0 mm.

7 Claims, 4 Drawing Sheets

NEEDLE BAR FOR A WARP DRAWFRAME

CROSS-REFERENCE TO RELATED APPLICATION

This is a continuation, under 35 U.S.C. §120, of copending international application No. PCT/EP2007/008345, filed Sep. 26, 2007, which designated the United States; this application also claims the priority, under 35 U.S.C. §119, of German patent application No. DE 20 2006 014 832.9, filed Sep. 28, 2006; the prior applications are herewith incorporated by reference in their entirety.

BACKGROUND OF THE INVENTION

Field of the Invention

The invention relates to a needle bar for a warp drawframe, in particular of a textile machine. It relates, further, to a warp drawframe with a number of such needle bars. A warp drawframe with a multiplicity of such needle bars is used in machines for combing and recombing and in spinning preparation.

A needle bar of this type, often also designated as a disposable needle bar, is mostly dimensioned in such a way that, when used in warp drawframes having warps with a warp division of 9.525 mm, a spacing relatively large in relation to its diameter is formed with respect to the needle bars adjacent in each case in the warp. The warp division is in this context understood as meaning the spacing of the longitudinal mid-axes of needle bars which are adjacent to one another and which are inserted into a warp of a warp drawframe of a textile machine. Conventional needle bars are subjected to often comparatively high flexion under the loads occurring during use, this resulting in impact-like loads on the warp and on the drive which drives the warp forward.

SUMMARY OF THE INVENTION

It is accordingly an object of the invention to provide a needle warp for a drawframe that overcomes the above-mentioned disadvantages of the prior art devices of this general type. The object on which the invention is based is to specify a particularly suitable needle bar for a warp drawframe, in particular for warps having a warp division of 9.525 mm.

With the foregoing and other objects in view there is provided, in accordance with the invention, a needle bar. The needle bar contains needles, a carrier bar having a diameter in a range of 7.0 mm to 7.7 mm, and a casing surrounding the carrier bar and holding a number of the needles lined up with one another. The casing has a thin-walled region with a wall thickness in a range of 0.9 mm to 1.25 mm.

The object is achieved, according to the invention, by a needle bar. For this purpose, the needle bar has a carrier bar with a bar diameter of 7.0 mm to 7.7 mm, the wall thickness of the casing in the thin-walled region amounting to between 0.9 mm and 1.25 mm.

In advantageous alternative versions, the carrier bar has, in particular, a bar diameter of 7.1 mm with a wall thickness of the casing in the thin-walled region of 1.2 mm, a bar diameter of 7.4 mm with a wall thickness of the casing in the thin-walled region of 1.0 mm, or a bar diameter of 7.4 mm with a wall thickness of the casing in the thin-walled region of 0.9 mm.

It has proved particularly advantageous to have a preferred configuration of the needle bar with a carrier bar diameter of 7.2 mm and with a wall thickness of the casing in the thin-walled region of 1.0 mm.

In an advantageous refinement, such a needle bar has a spacing between the longitudinal axis of the needles and the longitudinal axis of the carrier bar of, in particular, 2.75 mm. The needle offset thereby increased, that is to say the approach of the longitudinal axis of the needles of the needle bar to a take-off roller of the warp drawframe in the region of the exit of the fiber material to be processed, brings about an improvement in the quality of the sliver.

The advantages achieved by the invention are, in particular, that a needle bar configured according to the invention has comparatively high flexural rigidity. Thus, according to the conditions of use, needle bars may be specified, the carrier bar diameter of which lies in the indicated range of 7.0 mm to 7.7 mm and which, with thicknesses of the casing of between 1.25 mm and 0.9 mm, always have an overall diameter which allows use in warp drawframes having warps with a division of t=9.525 mm, so that only an insignificant to vanishing distance of the order of approximately 0.5 mm to 1.5 mm is formed between the needle bars lined up in the warp. In the region of maximum flexion, the needle bar can be supported against the needle bar adjacent in the warp drawframe in the direction of flexion, with the result that the forces which arise are transferred carefully to the warp and to the drive pushing this forward. Moreover, it became apparent that a correspondingly configured needle bar has a flexibility such that the forces acting on the needles during the intended use are damped.

Other features which are considered as characteristic for the invention are set forth in the appended claims.

Although the invention is illustrated and described herein as embodied in a needle warp for a drawframe, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1A:
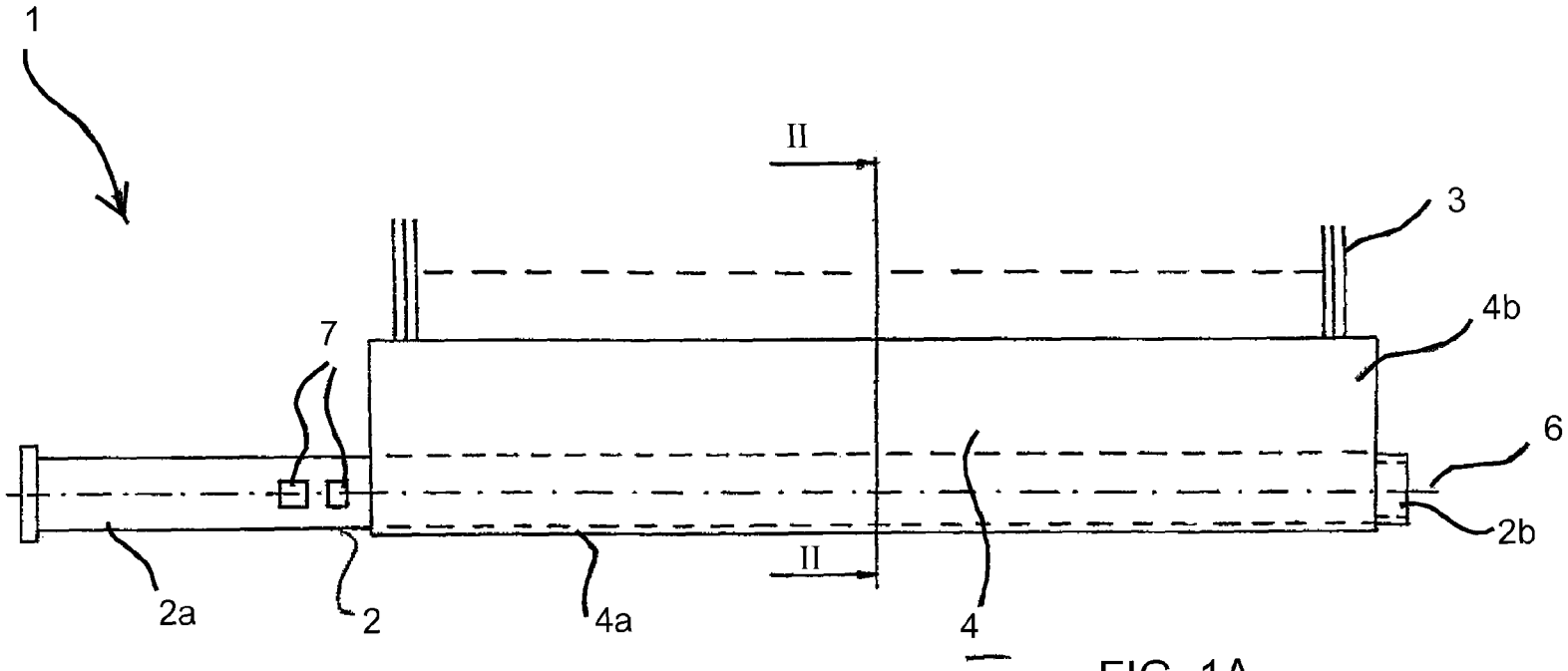
FIG. 1A is a diagrammatic, top plan view of a needle bar for a warp drawframe according to the invention.
Figure 1B:
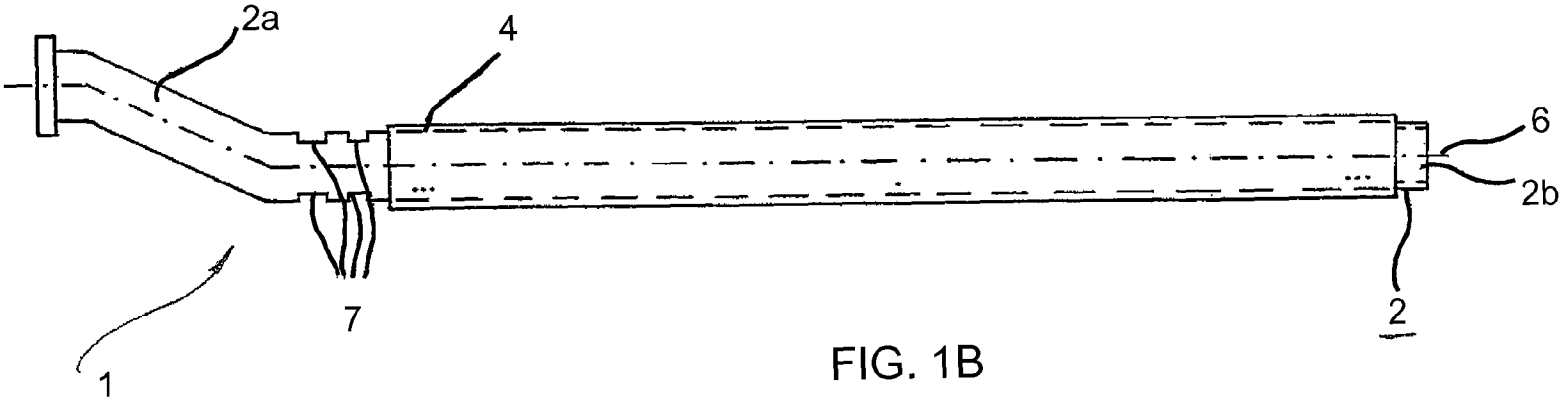
FIG. 1B is a diagrammatic, side view of the needle bar for a warp drawframe.

Parts corresponding to one another are given the same reference symbols in all the figures. Referring now to the figures of the drawing in detail and first, particularly, to FIGS. 1A and 1B thereof, there is shown a needle bar 1 for a warp drawframe 8 (see FIG. 4) in two different views. The needle bar has a carrier bar 2 which is configured at one end as a crank 2*a* and at the end facing away from the crank 2*a* is provided with a bearing bore 2*b*. The carrier bar 2 is surrounded by a casing 4 which is configured on one side as a rib 4*b*. A multiplicity of needles 3 are held in the latter in a row along a carrier bar longitudinal axis 6. The casing 4 is formed of a plastic material which is applied to the carrier bar 2 by an injection molding method, with the needles 3 being inserted. Two guide grooves 7 are arranged in pairs in each case on that portion of the carrier bar 2 which is located between the crank 2*a* and the rib 4*b*.

Figure 2:
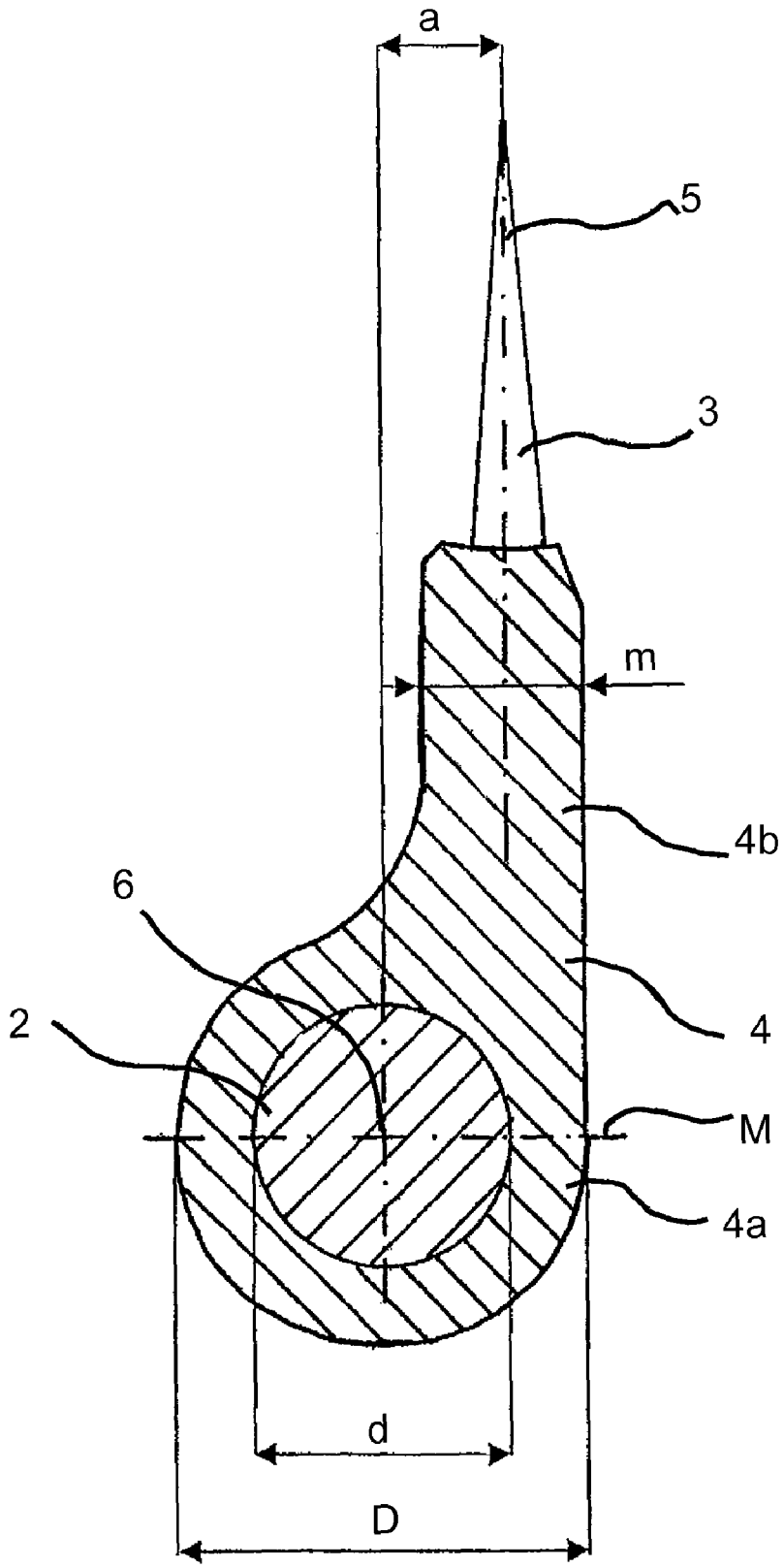
FIG. 2 is a diagrammatic, cross-sectional view of the needle bar taken along the line II-II shown in FIG. 1A.

FIG. 2 shows a sectional view of a needle bar. The carrier bar 2, which is identified by its diameter d, lies within the section. The thinnest-walled region 4*a* of the casing 4 lies, with respect to the carrier bar longitudinal axis 6, opposite that part of the casing 4 which is configured as a rib 4*b*. The thin-walled region 4*a* of the casing 4 extends at least over half the bar circumference of the needle bar 1, that is to say at least over the semicircular arc region of the needle bar 1 which, in the illustration, lies below the center line M, running through the longitudinal axis 6, of the carrier bar 2.

A spacing a, designated below as an needle offset, between the longitudinal axis of each needle 5 and the carrier bar longitudinal axis 6 is a difference between the radius D/2 of the needle bar 1 and half the thickness m/2 of the rib 4*b*. A rib thickness m=3.7 mm results, in the version according to the invention with a carrier bar diameter d=7.2 mm and a wall thickness of the casing of 1.0 mm in the thin-walled region 4*a*, in a needle offset of a=2.75 mm.

Figure 3:
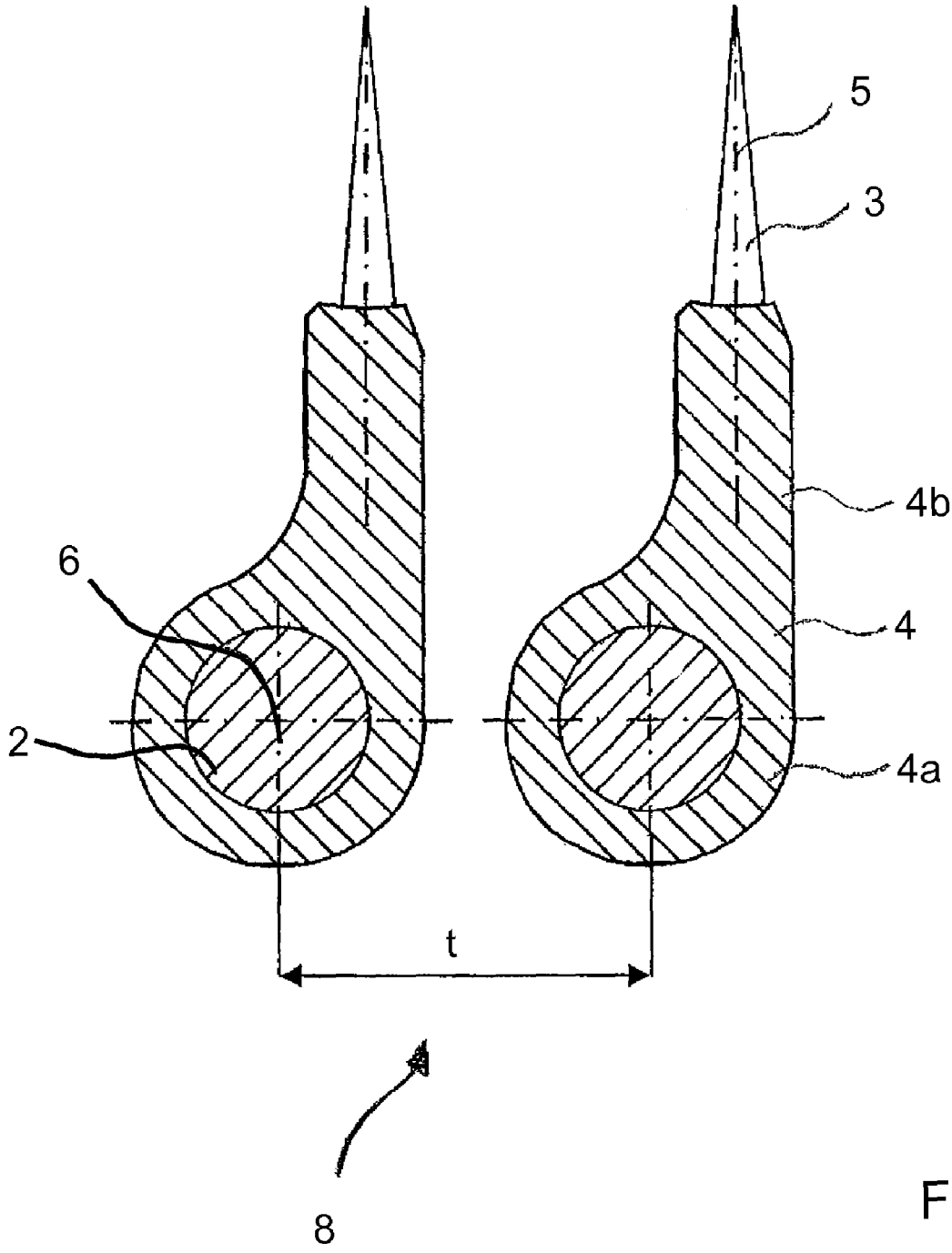
FIG. 3 is a diagrammatic, cross-sectional view of two needle bars according to FIG. 2 in their arrangement in a warp.

FIG. 3 shows the arrangement of two needle bars 1 in a warp drawframe 8 having a non-illustrated warp. The spacing, designated as t, between the carrier bar longitudinal axes 6 corresponds to what is known as the warp division of the warp used in the warp drawframe 10. The warp division of the warp preferably used amounts to t=9.525 mm.

Figure 4:
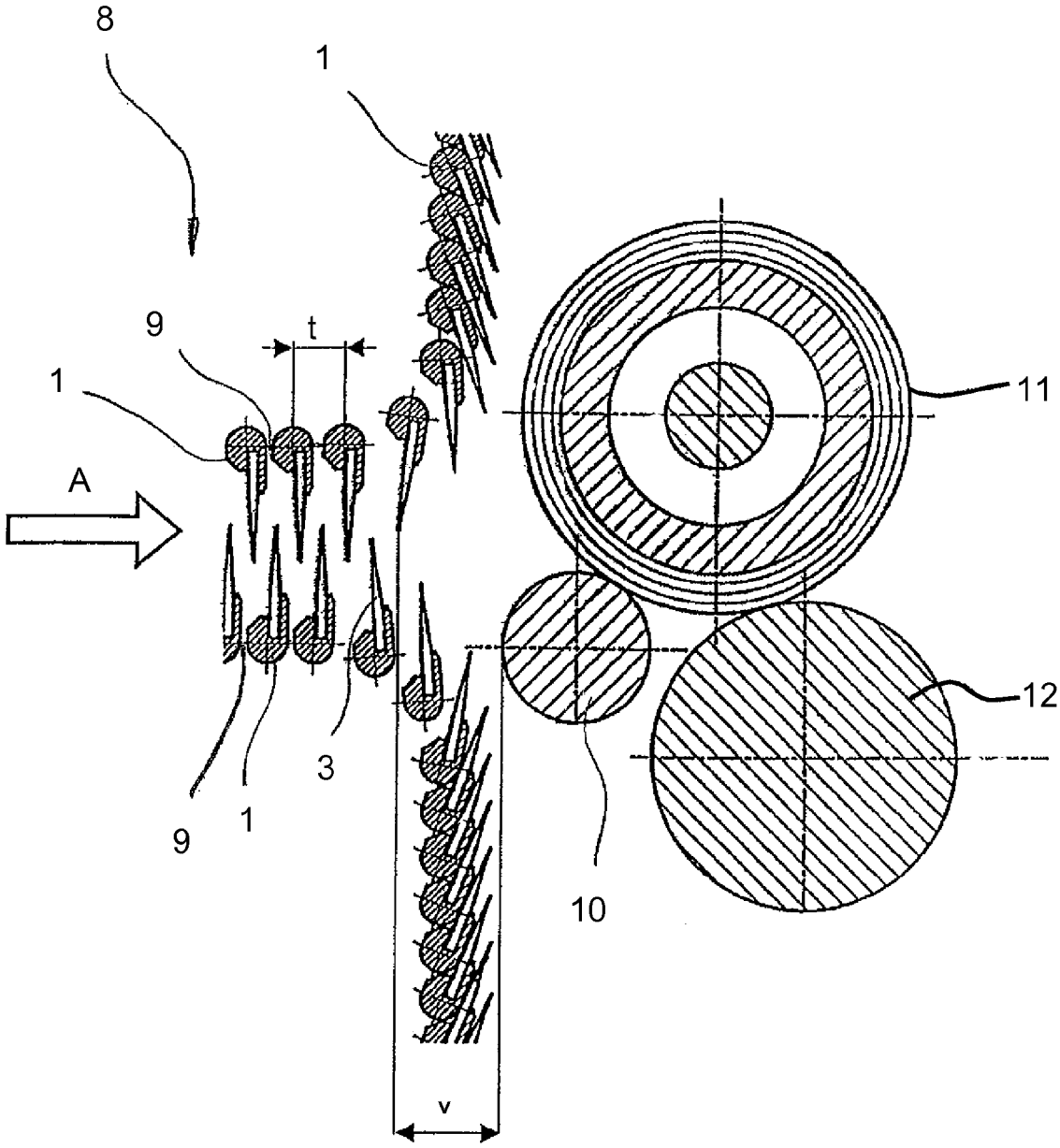
FIG. 4 is a diagrammatic, sectional view of an end of the warp drawframe with a number of needle bars arranged in warps and also a roller arrangement for transporting a sliver.

FIG. 4 shows the arrangement of a number of needle bars 1 in the warp drawframe 8 with two warps 9 of a textile machine. Here, A indicates the direction of advance of the warp drawframe 8. Located at the end of the warp drawframe 8 are a take-off roller 10 and two further rollers 11, 12 for the advance of the material which is processed in the textile machine in a way not illustrated in any more detail.

The needles 3 of the needle bars 1 used in the warp drawframe 8 are, up to the run-out distance v upstream of the take-off roller 10, in engagement with the material to be processed. By the needle offset a being increased from 2.15 mm to 2.75 mm, the run-out distance v upstream of the take-off roller 10 is reduced by 0.6 mm. What is achieved thereby is that the needles 3 of the needle bars 1 are in engagement for comparatively long in terms of time and/or space with the material to be processed, thus leading, in turn, to an improvement in the quality of the material to be raveled out.

The invention claimed is:

1. A needle bar, comprising:

needles;

a carrier bar having a diameter in a range of 7.0 mm to 7.7 mm; and a casing surrounding said carrier bar and holding a number of said needles lined up with one another, said casing having a thin-walled region with a wall thickness in a range of 0.9 mm to 1.25 mm.

2. The needle bar according to claim 1, wherein said diameter of said carrier bar is 7.2 mm and said wall thickness of said thin-walled region is 1.0 mm.

3. The needle bar according to claim 1, wherein said thin-walled region of said casing extends, on an underside, facing away from said needles of said carrier bar, at least over half a bar circumference of the needle bar.

4. The needle bar according to claim 1, wherein:

said needle has a longitudinal axis; and said carrier bar has a longitudinal axis, a spacing (a) between said longitudinal axis of a needle and said longitudinal axis of said carrier bar is between 2.6 mm and 2.9 mm.

5. The needle bar according to claim 1, wherein:

said needle has a longitudinal axis; and said carrier bar has a longitudinal axis, a spacing between said longitudinal axis of said needle and said longitudinal axis of said carrier bar is 2.75 mm.

6. A warp drawframe for a textile machine, the warp drawframe comprising:

at least two transport warps each having a number of needle bars, said needles bars each containing:

needles;

a carrier bar having a diameter in a range of 7.0 mm to 7.7 mm; and a casing surrounding said carrier bar and holding a number of said needles lined up with one another, said casing having a thin-walled region with a wall thickness in a range of 0.9 mm to 1.25 mm.

7. The warp drawframe according to claim 6, wherein said at least two transport warps each have a warp division of t=9.525 mm and a run-out distance reduced in a direction of a take-off roller by an amount of a spacing between a longitudinal axis of each of said needles and a longitudinal axis of said carrier bar.

* * * * *